United States Patent [19]

Kelland

[11] 4,261,815

[45] Apr. 14, 1981

[54] MAGNETIC SEPARATOR AND METHOD

[75] Inventor: David R. Kelland, Lexington, Mass.

[73] Assignee: Massachusetts Institute of Technology, Cambridge, Mass.

[21] Appl. No.: 108,779

[22] Filed: Dec. 31, 1979

Related U.S. Application Data

[63] Continuation-in-part of Ser. No. 664,783, Mar. 8, 1976, abandoned.

[51] Int. Cl.[3] ..... B03C 1/00

[52] U.S. Cl. ..... 209/213; 209/223 R

[58] Field of Search ..... 209/38, 214, 223 R, 209/213, 272, 232, 214; 210/277, 223

[56] References Cited

U.S. PATENT DOCUMENTS

| | | | |
|---|---|---|---|
| 2,029,078 | 1/1936 | Matney | 210/223 |
| 2,258,194 | 10/1941 | Queneau | 209/219 |
| 2,943,739 | 9/1960 | Magnard | 210/222 |
| 3,325,925 | 4/1967 | Carpenter | 209/214 |
| 3,346,116 | 10/1967 | Jones | 210/222 |
| 3,567,026 | 3/1971 | Kolz | 210/222 |
| 3,608,718 | 9/1971 | Abrey | 210/222 X |
| 3,627,678 | 12/1971 | Marston | 30/222 X |
| 3,920,543 | 3/1973 | Marston | 209/222 |
| 4,144,163 | 3/1979 | Kolz | 209/214 X |

FOREIGN PATENT DOCUMENTS

| | | | |
|---|---|---|---|
| 58797 | 6/1890 | Fed. Rep. of Germany | 210/222 |
| 870532 | 9/1942 | Fed. Rep. of Germany | 209/223 R |
| 2501858 | 1/1974 | Fed. Rep. of Germany | 210/222 |
| 2433008 | 1/1975 | Fed. Rep. of Germany | 209/223 R |
| 226922 | 5/1943 | Switzerland | 210/222 |

*Primary Examiner*—Robert Halper

*Attorney, Agent, or Firm*—Arthur A. Smith, Jr.; Robert Shaw

[57] ABSTRACT

A separator to receive a fluid slurry containing magnetic particles and non-magnetic particles and operable to increase the concentration of the magnetic particles at one region within the slurry and deplete the concentration of the magnetic particles at another region of the slurry. There are no moving parts in this separator and its operation is continuous.

18 Claims, 8 Drawing Figures

MAGNETIC SEPARATOR AND METHOD

The Government has rights in this invention pursuant to Contract No. NSF-74-58-C-670 and Institutional Patent Agreement No. 0010, awarded by the National Science Foundation.

This is a continuation-in-part of Ser. No. 664,783 now abandoned filed Mar. 8, 1976.

The present invention relates to magnetic separators.

Magnetic separators have had a long history of usage in industry, but, if anything, that usage is increasing. In this connection, attention is called to an article in the *Scientific American*, November 1975, pp. 46–54 which discusses, among other things, a rather recent development referred to therein as the Kolm-type separator which employs a fibrous matrix; see U.S. Pat. No. 3,676,337. The matrix-type separator traps particles which must be removed from the matrix during part of a duty cycle or after the matrix has been removed from the magnetic field as is done in the continuous Carousel-type separator (e.g., U.S. Pat. No. 3,902,994). While the matrix-type (e.g., Kolm-type) separator is necessary for the separation of weakly magnetic particles, its use is not necessary in cases wherein the particles are larger or more magnetic. Present forms of open-gradient magnetic separators in use for the separation of magnetite from silica and other applications in which the material to be concentrated is highly magnetic are required to produce a magnetic field gradient across the working volume (separation region) of the separator. This assures that the value of gradient will be small and therefore limits their usefulness for small or relatively more weakly magnetic particles.

An object of the present invention is to provide a new and improved magnetic separator to separate magnetic particles (mags) from non-magnetic particles (tailings) in a fluid slurry that contains both and in which a large part of the particles in the slurry is mags.

Another object is to provide a magnetic separator to separate particles which are too small or weakly magnetic to be separated in a conventional open-gradient type separator but which are not small enough or so weakly magnetic as to require a matrix-type separator.

These and still further objects are discussed hereinafter and are particularly delineated in the appended claims.

The foregoing objects are achieved in a magnetic separator or concentrator that receives slurry as a fluid stream containing magnetic particles and non-magnetic particles and acts to concentrate the magnetic particles at a plurality of first transversely-spaced regions of the stream and to deplete magnetic particles from a plurality of second transversely-spaced regions of the stream. The separator or concentrator includes an elongate, non-magnetic outer housing that receives the slurry which flows axially through the housing. A plurality of small-diameter, ferromagnetic rods or wires are disposed within and oriented parallel to the axis of the housing (and hence parallel to the flow velocity of the fluid stream); the rods are transversely spaced from one another. Downstream from one end of each rod the housing is divided into a plurality of open-ended transversely spaced channels, a group of four such channels being disposed about each rod and acting as a unit; two channels of the group having open ends in the first regions or collection zones of the separator or concentrator and the other two channels of the group having open ends in the second region or depletion zones thereof. The volume within the housing between said one end of each rod and the open ends of the channels is a separation region. Means is provided to create in the separation region a magnetic field that is oriented transversely to the longitudinal axes of the parallel rods. The magnetic field is distorted by the presence of the ferromagnetic rods in such a way as to produce in certain regions about each rod a magnetic field gradient which can be represented by a radial component and a rotational or angular component. In certain regions the radial component is directed toward the rod and in other regions it is directed away from the rod. The rotational component can be clockwise or counterclockwise about the rod. As the slurry moves in a stream axially along the rods, radial forces and rotational forces due to the magnetic field gradient thereabout act to concentrate the magnetic particles in the slurry at said first regions where they are collected by the first-named two channels of a group and to deplete the magnetic particles in the slurry at said second region where the other two channels of a group thus collect slurry with a high proportion of non-magnetic particles.

The invention is hereinafter described with reference to the accompanying drawing in which.

Figure 1:
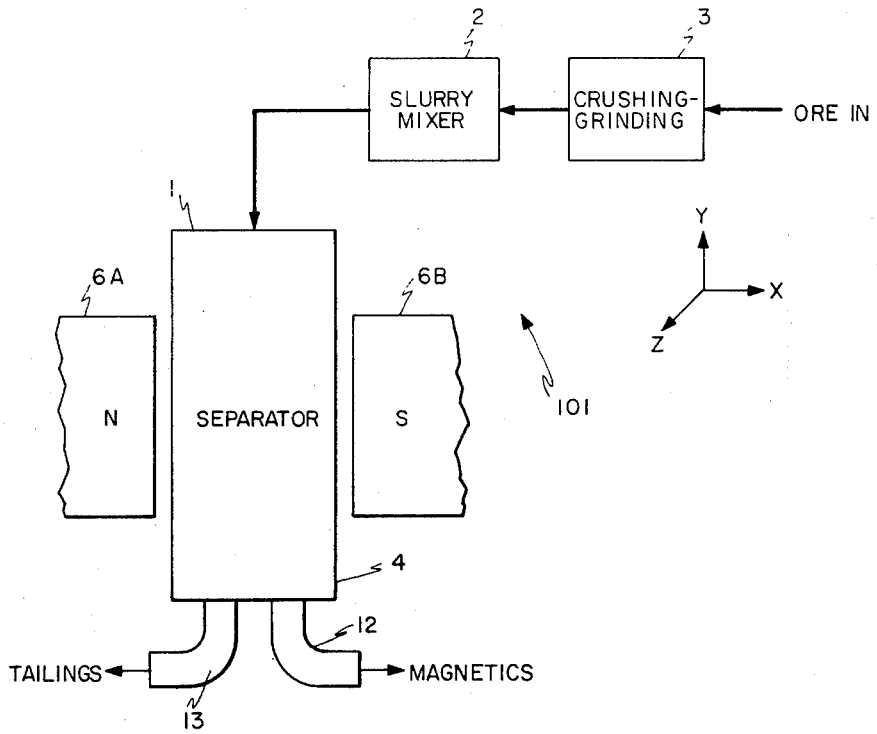
FIG. 1 is a diagrammatic representation, partly block diagram in form, of a system that includes a separator of the present invention.

Turning now to FIG. 1, the system labeled 101 comprises a pulverizer 3 to receive taconite or other ore and to reduce it to necessary particle size for liberation of waste particles from magnetic particles. The ore containing magnetizable or magnetic particles and non-magnetic particles is delivered to a mixer 2 where it is mixed with fluid to form a slurry that contains particles having a range of magnetic moments from highly magnetic to very weakly or non-magnetic. The slurry in the form of a fluid stream is delivered to a distributed-gradient separator or concentrator 1 where the two are divided from one another and exit as magnetics or mags at 12 and as tailings at 13. It will be appreciated as the explanation continues that there are non-magnetic particles that emit from the exit 12, but that what is done here is to increase the proportion of magnetic or magnetizable particles that emit from the separator or concentrator at the exit 12.

Figure 2:
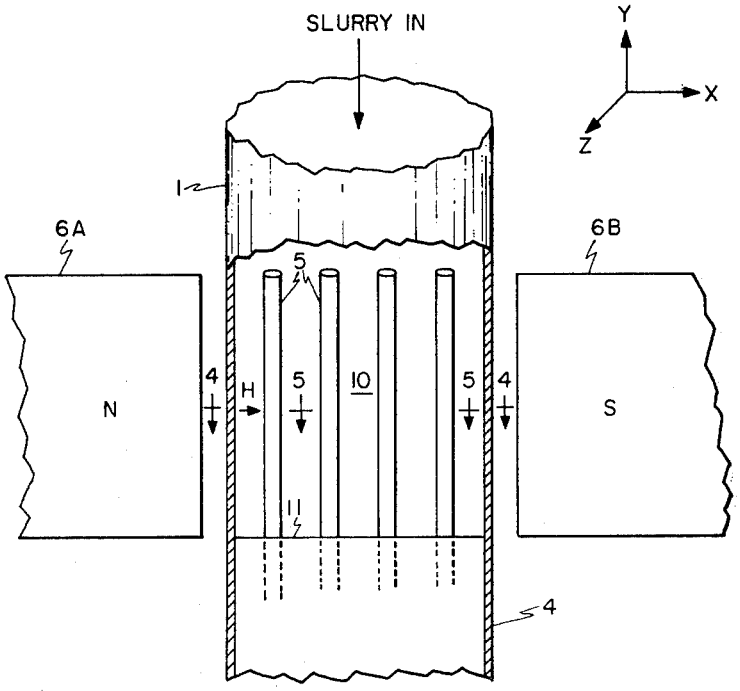
FIG. 2 is an enlarged side elevation view, partly cutaway, of the separator of FIG. 1 and shows a plurality of ferromagnetic wires or rods that extend axially within the elongated housing of the separator, the rod diameter being greatly enlarged in proportion to the housing diameter and the number of rods shown being greatly reduced from the number that would be used in actual apparatus.
Figure 3:
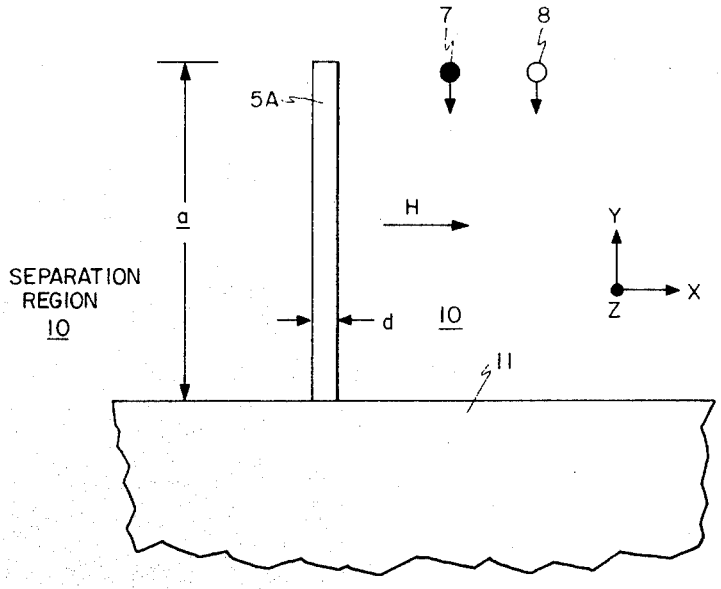
FIG. 3 is a side elevation view of one of the wires or rods of FIG. 2.

The separator 1 comprises an elongate, non-magnetic housing 4 and a plurality of ferromagnetic wires or rods 5 (see FIG. 2) that extend axially (i.e., in the y-direction) within the vertically-oriented elongate housing 4. Pole pieces 6A and 6B introduce to the space occupied by the rods 5 a transverse or cross field H (e.g., oriented in the x-direction in FIG. 2) for purposes to be discussed, the field being present at the upstream portions of the rods 5. In FIG. 3 the particle shows at 7 is a magnetic particle and the particle shown at 8 is a non-magnetic particle; the particles 7 and 8 move into the region marked 10 of the separator by virtue of the longitudinally downward moving slurry stream. The magnetic particles 7 can be magnetized by the H field in the region 10, which is at the upstream portions of the rods 5. In any event, the region 10 serves as a separation region wherein the particles 7 and 8 are separated from one another prior to entry to a baffled structure 11 which is located at the downstream ends of rods 5. The rods 5 extend the whole of the axial distance through the separation region 10, as shown in FIG. 2, and slightly beyond. The separation process is now described with reference mostly to FIGS. 3, 5 and 6, the goal here being to increase the percentage of magnetic particles 7 over the non-magnetic particles 8 in an effluent from the output 12 in FIG. 1.

Figure 5:
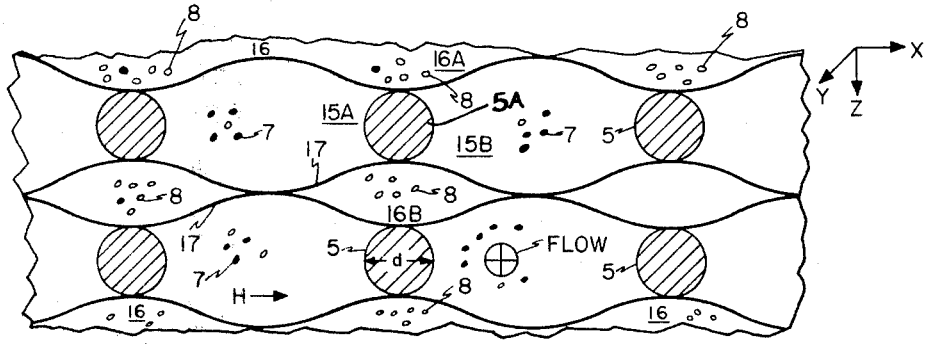
FIG. 5 is a partial enlarged section view taken upon the lines 5—5 in FIG. 2 and looking in the direction of the arrows.
Figure 6:
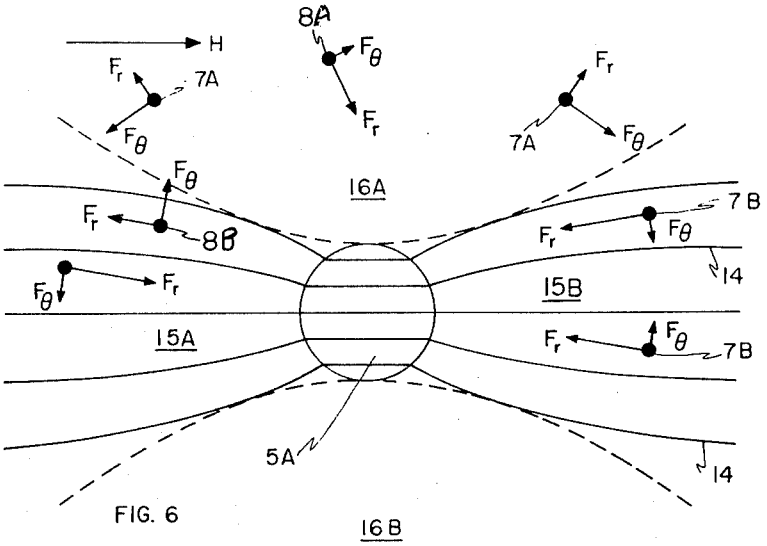
FIG. 6 is a diagrammatic plan view of one of the wires or rods of FIG. 2 and shows magnetic field lines in the vicinity of the wire.

As the particles 7 move into the region 10, the are subjected to a magnetic field gradient around the rods 5. For this explanation the single rod in FIG. 6 is marked 5A and is similarly marked in FIG. 5. The magnetic field lines shown at 14 in FIG. 6 converge toward the rod 5A. Each magnetic particle 7 in the region 10 has a magnetic force (in addition to the flow force) upon it, which can be resolved into the force components marked $F_r$ and $R_\theta$. The two force components $F_r$ and $F_\theta$ create collection zones 15 in FIG. 5 at first transversely-spaced regions of the fluid stream, that is, zones of relatively large magnetic or magnetizable particle content, and depletion zones 16 at second transversely-spaced regions of the fluid stream, that is, zones of relatively large non-magnetic content. In FIGS. 5 and 6 the collection zones around the conductor 5A are designated 15A and 15B and the depletion zones are designated 16A and 16B. It will be appreciated that enhancement of mags in the zones 15A and 15B is due to the effect of the fringing field upon the magnetic particles at the upstream portion of the rods 5 (i.e., in the separation region 10) and not to any effect upon the non-magnetic particles 8 since the latter are unaffected by the field H. In the zone 16A, as shown in FIG. 6, the force $F_r$ upon magnetic particles 7A is radially away from the rod 5A and the force $F_\theta$ is toward the collection zone 15A or the collection zone 15B; in the zone 15B the force $F_r$ on magnetic particle 7B is radially toward the rod 5A and the force $F_\theta$ is toward the center of the collection zone and is reduced in value. It can be shown that the resultant force $(\overline{F}_r+\overline{F}_\theta)$ on any particle 7 in the depletion zone 16 acts to move or drive the particle toward a collection zone 15 and the resultant force on any particle 7 in a collection zone 15 acts to keep it there. (The labels 15 and 16 are used herein to denote collection zones or regions and depletion zones or regions, respectively; but they are used also to denote channels that collect slurry containing high concentration and low concentration of mags, respectively. The channels operate in groups of four, the two first channels such as channels 15A and 15B (or the collection zones) serving to collect high concentrations of magnetizable particles 7 and channels 16A and 16B (at the depletion zones) to collect slurry with relative lower concentrations of magnetizable particles 7.)

The transverse magnetic field H, in the absence of the rods 5, would be substantially uniform, but, as shown in FIG. 6, it is distorted by the ferromagnetic rods 5A to provide about the rods 5A a magnetic field gradient component toward the rod 5A and a rotational gradient component and in other regions to provide about the rod 5A a magnetic field gradient component away from the rod 5A and a rotational gradient component. The radial magnetic field gradient components produce the forces $F_r$ in FIG. 6 and the rotational gradient components produce the forces $F_\theta$. In this way the magnetic particles are concentrated in the regions 15A and 15B and depleted in the regions 16A and 16B; hence, the two channels or chambers 15A and 15B serve to collect slurry with a high proportion of the magnetizable or magnetic particles 7 and the two channels or chambers 16A and 16B serve to collect slurry with a high proportion of the non-magnetic particles 8.

It will be appreciated on the basis of this explanation that the length marked a of the separation region 10 in FIG. 3 is important and must be related to the flow rate of the slurry through the separator 1, the magnetic character of the mags, the character of the fluid, etc., to give the magnetic forces enough time to effect their purposes before the particles enter the baffled structure 11 so that the concentration of magnetic particles in the collection zones 15 is increased and that in the depletion zones 16 decreased.

Figure 4:
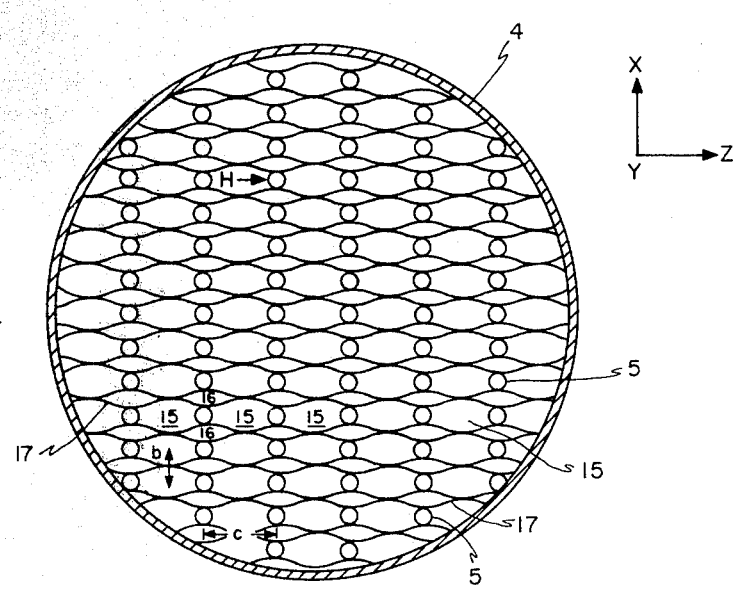
FIG. 4 is a section view taken upon the lines 4—4 in FIG. 2 and looking in the direction of the arrows and shows more nearly the proportion between rod diameter and housing diameter and also a more reasonable number of rods.

An example chosen for calculation provided rods of diameter 200$\mu$ 0.2 millimeters (or 0.008 inches) spaced such that the dimensions b and c in FIG. 4 were both two millimeters. The magnetic particles were chosen to have a radius of 0.1 millimeter and have a magnetic susceptibility (paramagnetic) of $10^{-4}$ (0.0001) emu (electromagnetic units). The applied magnetic field was set at 2000 gauss and the saturation magnetization of the ferromagnetic rods was considered to be not less than 2000 gauss.

Under these conditions, the particle with the longest path over which to migrate into the collection zone would take five seconds to do so (in water). More typical times are one-half to one second. The residence times for magnetic particles be to effectively concentrated would be of the order of seconds. For this example, if one takes a residence time of two seconds and requires the separator to work at a flow rate of ten cm/sec. then the length of the separation region is 20 cm. (or about 8 inches).

The baffled structure 11 is formed of non-magnetic walls 17 which can be corrugated aluminum, fiberglass, or the like, which divide the structure 11 into the axially-oriented channels or open-ended chambers 15 with a rod 5 at the intersection of a group of four chambers or channels. Thus, for example, in terms of this specification, the zones 15A–15B and 16A–16B are channels to collect mags and tailings, respectively, and to deliver the same to the outputs 12 and 13, respectively. The collection zone channels are brought together at the lower end of the vertically oriented housing 4 to a plenum or manifold and then connected to the output 12, and the depletion zone channels similarly converge or exhaust to a plenum or manifold which is connected to the output 13.

Figure 7:
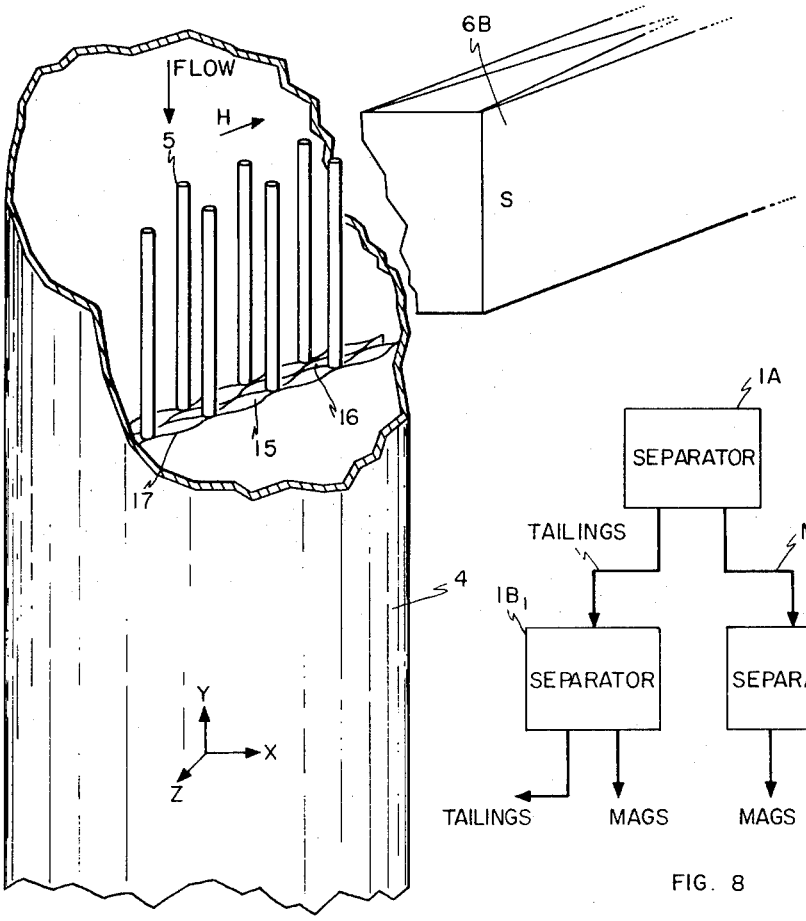
FIG. 7 is an isometric cutaway of a portion of the separator or concentrator of FIG. 2 again rod size and number are not properly proportioned.

As shown in FIG. 4, the present invention contemplates many closely-spaced rods 5; the b dimension in FIG. 4 typically in two mm and the rod diameter typically is 0.2 mm. It should be noted in this connection that the diameter d of the rods should be small to provide the necessary high field gradient to effect concentration of the magnetic particles, but it cannot be so small that it will not affect the field H. Positioning of the vertically oriented rods 5 shows quite clearly in the cutaway view of FIG. 7.

The separator 1 thus provides a distributed-gradient mechanism for separating particles which are too small or weakly magnetic to be separated in an open-gradient separator but which are not small enough or weakly magnetic enough to require a matrix-type separator. This is accomplished by distributing individual magnetic field gradients throughout the slurry stream, which cannot be done in an open-gradient device. Further, through the use of small wires or rods 5, large gradients can be made by the distortion of a uniform field and, hence, large forces can be exerted on small particles which can cause a displacement relative to the field. This displacement results in enriched (with magnetic particles) regions of the slurry for mag collection.

By not going all the way to a trapping matrix separator such as the Kolm type, the present separator provides continuous operation with no moving parts. It operates in a regime where no practical separator is now applicable.

Figure 8:
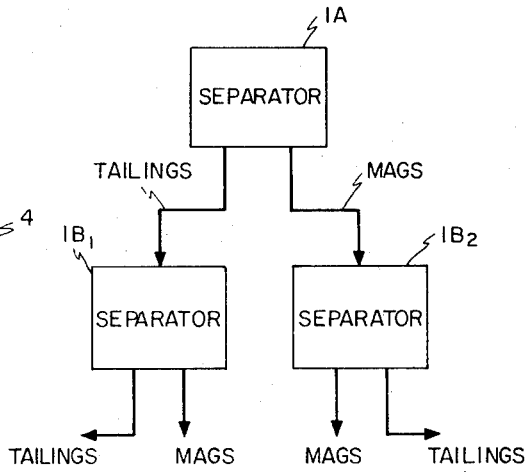
FIG. 8 is a diagrammatic representation, block diagram in form, of a system that includes several separation stages.

Real ore samples contain particles of different composition and size. The magnetic movement and other physical properties vary over a range of values. A single stage of separation would utilize a separator of given wire diameter length and wire spacing. It is therefore not possible to match the separator dimensions and operating parameter values of a single stage separator to a real ore sample and achieve the maximum performance which comes from matching separator with particle size and magnetic moment. Several serial stages, as shown in FIG. 8, may be employed, therefore, in which the dimensions, spacing, the operating parameters, spacing, and operating parameters are different. Magnetic field, flow rate, retention time, wire size and spacing, and length may all be arranged differently to match, in the various stages, the range of properties of the particles encountered.

The first stage might be arranged to split off larger and more magnetic particles with later stages containing finer wires which create a higher magnetic field gradient necessary to attract smaller and more weakly magnetic particles. Particles too small and without sufficient magnetic moment to be concentrated in this cascaded type separator might then be collected in a Kolm-type separator.

The magnetic field can be provided in the present invention by a parmanent magnet, iron core electromagnet or superconducting magnet. The choice depends on the magnetic field required and the economics of producing that field in the volume of the separation region. In the present literature, fields over twenty kilogauss are considered to require the use of a superconducting magnet for their production.

The above discussion emphasizes a situation in which the particles 7 are magnetic in a slurry wherein the fluid carrier is water, for example and, thus, the magnetic particles have a greater positive susceptibility per unit volume than the fluid (i.e., the water). The important issue here, however, is the relative susceptibilities between the particles in the slurry and the fluid therein. In the explanation below $\chi_p$ is the susceptibility (per unit volume) of a particle in a slurry and $\chi_f$ is the susceptibility (per unit volume) of the fluid (which typically is a liquid; but may be a gas). In the discussion $\chi$ is used to designate susceptibility in general; $\chi+$ herein designates materials with positive susceptibility and $\chi-$ designates materials with negative susceptibility.

The force f on a magnetic particle in a fluid which finds itself in a magnetic field gradient is given by $$F = (\chi_p - \chi_f)\, VH \frac{\partial H}{\partial X} \tag{1}$$

where H is the applied magnetic field, V is the particle volume, $\partial H/\partial X$ is the magnetic field gradient and $(\chi_p - \chi_f)$ is the magnetic susceptibility per unit volume of the particle relative to the fluid. The relationship in equation 1 arises from the fact that the particle displaces an equal volume of the fluid. The force is derived by differentiation from the magnetic energy change (the work done) in bringing the particle into the gradient from far away ($\infty$). Of course, the work W done in taking the displaced equal volume of fluid away must also be calculated and all the work done must be combined. The sum of the positive work done in bringing the particle into the gradient and the negative work done in removing the fluid is the net energy change given by $W = \frac{1}{2}(\chi_p - \chi_f)H^2$ (per unit volume). Differentiating for the force F gives eq. 1.

There are three main classes of magnetic materials: ferromagnetic, paramagnetic and diamagnetic. $\chi$ is considered to be positive for the first two and negative for diamagnetic materials, i.e., diamagnetic materials are repelled by a field gradient. More accurately, diamagnetics experience a force in the direction of weaker field. Fluids are often diamagnetic, e.g., most organics and water. $\chi_f$ of a liquid can be changed by dissolving paramagnetic or diamagnetic salts therein. The well known case of $Mn\ Cl_2$ in water is an example.

So, there are several situations which can exist that affect the sign of $(\chi_p - \chi_f)$ and therefore the sign of the magnetic force.

TABLE A

| $X_p$ | $X_f$ | force (F) |
|---|---|---|
| paramagnetic | paramagnetic | + or − |
| paramagnetic | diamagnetic | + |
| diamagnetic | diamagnetic | + or − |
| diamagnetic | paramagnetic | − |

The absolute value of the term $(\chi_p - \chi_f)$ can be changed for a given particle by adjusting the $\chi_f$ of the fluid in any one of the above cases. The most common examples would be by dissolving diamagnetic or paramagnetic salts in water.

The previous discussion herein with regard to magnetic or magnetizable particles 7 and non-magnetic particles 8 pre-supposes a fluid (gas or liquid) with $\chi_f$ less positive then $\chi_p$, or $(\chi_p - \chi_f)$ positive, but this is not always true. $(\chi_p - \chi_f)$ can be negative; therefore, a generalized discussion for more than one kind of particle, i.e., several species of particles each with its own value of $\chi_p$ suspended in a fluid with $\chi_f$ positive or negative and adjustable in absolute value can be made. There are only two cases to consider: $(\chi_p-\chi_f)$ positive or negative (or zero, but this will occur rarely unless arranged by fluid adjustment). In fact, the susceptibility $\chi_f$ of the fluid may be adjusted to lie between the susceptibilities of two particulate species, both paramagnetic or both diamagnetic or both different. The first case is discussed above in the earlier discussion and is illustrated in FIGS. 5 and 6 by particles 7. The particle 7 will migrate from the zones 16, termed depletion zones, to the so-called collection zones 15. Now, one can change the names of these zones to positive gradient zone 15 and negative gradient zone 16 because either of them may serve as collection zones depending on the sign of the term $(\chi_p-\chi_f)$ for a given particulate species. One can also drop the name non-magnetic for the particles 8 above discussed. These are in fact either particles which experience smaller forces because of having less susceptibility relative to the fluid or a relative susceptibility of opposite sign, i.e., $(\chi_p-\chi_f)$ negative, through any of the possible combinations in Table A above. This, in general, is called diamagnetic capture or collection and it occurs in the negative gradient zones 16 as illustrated in FIG. 5 by a larger number of the particles 8 in zones 16 and in FIG. 6 by two added particles 8A and 8B with the force components in the radial and rotational directions (r and $\theta$, respectively) shown for both zones. The discussion just made clarifies the magnetic capture of all possible magnetic particulate species in fluids, of all possible susceptibilities.

Modifications of the invention herein disclosed will occur to persons skilled in the art and all such modifications are deemed to be within the spirit and scope of the invention as defined by the appended claims.

What is claimed is:

1. A magnetic separator having, in combination, a non-magnetic elongate outer housing to contain the flow of a fluid slurry containing magnetizable particles and non-magnetic particles;

a plurality of adjacently disposed, axially oriented channels positioned within the elongate outer housing, the walls of the channels being non-magnetic, said channels being oriented substantially parallel to the elongate axis of the elongate outer housing in the separation region and having an open end in the separation region, said channels operating in groups of four, two first channels to collect high concentrations of magnetizable particles separated by two second channels to collect high proportions of non-magnetic particles;

a small-diameter ferromagnetic rod lying at the intersection of each group of four channels and extending upstream from the open ends or entrances of the channels, the extent of said rods being through the separation region;

means for creating in said separation region a substantially uniform applied magnetic field, said applied magnetic field being in a direction which is transverse to the longitudinal axis of the rod and being distorted by the ferromagnetic rod to produce about the rod a radial component of the magnetic field gradient and a tangential component of the magnetic field gradient, the forces due to the component of the field gradient acting to attract the magnetizable particles to first regions and to cause a depletion thereof at second regions, the two first channels being located at the first regions and serving to collect slurry with a high proportion of the magnetizable particles and the two second channels being located at the second regions and serving to collect slurry with a high proportion of the non-magnetic particles.

2. A magnetic separator as claimed in claim 1 in which the rod is circular in cross dimensions and the diameter thereof is small enough to provide the high magnetic field gradients needed to concentrate the magnetizable particles but not so small that the effect thereof upon applied magnetic field is insubstantial.

3. A separator as claimed in claim 1 wherein the means for creating a magnetic field is operable to create a field that varies in intensity.

4. A separator as claimed in claim 1 having many said rods with a group of channels associated with each said rod.

5. A separator as claimed in claim 1 wherein the means for creating the magnetic field is permanent magnet means.

6. A separator as claimed in claim 1 wherein the means for creating the magnetic field is an electromagnet means.

7. A separator as claimed in claim 1 wherein the means for creating the magnetic field is a superconducting magnet.

8. A separator as claimed in claim 1 wherein the means for creating a magnetic field is a cryogenic magnet.

9. A plurality of separators as claimed in claim 1 serially connected.

10. A magnetic separator that receives slurry as a fluid stream containing magnetic or magnetizable particles and non-magnetic particles and acts to concentrate the magnetic or magnetizable particles at a plurality of first transversely-spaced regions of the streams and deplete magnetic or magnetizable particles from a plurality of second transversely-spaced regions of the stream, that comprises:

a non-magnetic outer housing to receive the slurry in the form of a fluid stream which flows through the housing in the longitudinal direction;

a plurality of small-diameter, transversely-spaced ferromagnetic rods disposed within the housing and oriented substantially in said longitudinal direction, the slurry flowing longitudinally past the rods as it moves longitudinally through the housing;

means providing a transverse magnetic field in the space occupied by the rods and, in particular, at the upstream portion of the rods to provide high magnetic field gradients around said upstream portions, said field gradients creating forces upon the magnetic or magnetizable particles, said forces serving to move the magnetic or magnetizable particles transversely within the fluid stream toward said first regions, one of said plurality of transversely-spaced regions being disposed at each side of each rod;

and a plurality of channels disposed adjacent each rod and being located downstream from the upstream portion of the rod, the fluid stream entering the channels only after it has spent sufficient time in said upstream portion for a significant amount of said magnetic or magnetizable particles to migrate by virtue of said forces to said first regions.

11. A method of open gradient magnetic separation in which magnetic gradients are distributed throughout an open separation region, that comprises: introducing a slurry comprising a fluid that contains particles having a range of magnetic moments to a separation region to move through said region in one direction as a continuous flow stream; applying a magnetic field in said region generally directed transverse to said one direction; providing in said separation region ferromagnetic rods that extend generally in said one direction and extend through the separation region to provide said magnetic gradients at many transversely-spaced parts of the separation region; providing groups of channels to receive the slurry after the slurry has passed through the separation region, the particles with relatively higher magnetic moment while in the separation region being concentrated in certain zones of the slurry by virtue of the magnetic field gradients so that slurry with a higher proportion of particles having a high magnetic moment are received on a continuous basis as a continuous flow stream by some channels and slurry with a higher proportion of particles with a lesser magnetic moment are received on a continuous basis as a continuous flow stream by other of the channels.

12. A magnetic concentrator that receives a slurry as a continuous-flow fluid stream containing magnetic particles and non-magnetic particles and that acts to concentrate the magnetic particles at a plurality of first transversely-spaced collection zones of the stream and to deplete magnetic particles from a plurality of second transversely-spaced depletion zones of the stream, said magnetic concentration comprising, in combination:

(a) concentrating means comprising a plurality of small-diameter, ferromagnetic rods disposed in a separation region substantially parallel to the flow velocity of the fluid stream in said separation region, the rods being transversely spaced from one another, and magnetizing means to create in the separation region a magnetic field that is oriented substantially transversely to the longitudinal axes of the parallel rods, the separation region being an open volume except for said rods, the magnetic field in the separation region being distorted in such a way as to produce in certain regions about each rod a magnetic field gradient which can be represented by a radial component and a rotational or angular component, the radial component or magnetic field gradient at some said certain regions being toward the particular rod and at other said certain regions being away from the particular rod, the rotational or angular component at some said certain regions being clockwise about a particular rod and at other said certain regions being counterclockwise, so that, as the slurry moves in a continuous flow stream axially along the rods, radial forces and rotational or angular forces due to the magnetic field gradient about each rod act to concentrate the magnetic particles in the slurry at said collection zones and to deplete the magnetic particles in the slurry from the depletion zones;

(b) baffled structure means comprising open-ended, transversely-spaced channels, a group of four such open-ended channels being disposed about each rod and acting as a unit as to the rod associated therewith, the open ends of the channels of a unit being disposed downstream from one end of the rod associated therewith, the volume between said one end of the rod and the open ends of the channels constituting said separation region, the open ends of two channels of each unit being disposed at the collection zones about the associated rod to collect slurry with a high proportion of magnetic particles and the open ends of the other two channels of each unit being disposed at the depletion zones to collect slurry with a high proportion of non-magnetic particles; and (c) plenum means connected to receive the contents of the channels which contain slurry with a high proportion of magnetic particles, that is, the collection zone channels, and the contents of the channels which contain slurry with a high proportion of non-magnetic particles, that is, the depletion zone channels, and to exhaust the contents of the collection zone channels at a first output and the contents of the depletion zone channels at a second output displaced from the first output.

13. A method as claimed in claim 11 that further includes exhausting the slurry in said same channels to one location and the slurry in said other of the channels to another location displaced from the first location.

14. A method of open gradient magnetic separation in which magnetic gradients are distributed throughout an open separation region, that comprises: introducing to said region a slurry comprising a fluid of susceptibility $\chi_f$ and particles whose susceptibilities $\chi_p$ are in a range such that for some particles $(\chi_p-\chi_f)$ is positive and for other particles $(\chi_p-\chi_f)$ is negative, which slurry moves through said region in one direction as a continuous flow stream, applying a magnetic field in said region generally directed transverse to said one direction; providing in said separation region magnetic rods that extend generally in said one direction and extend through the separation region to provide said magnetic gradients at many transversely-spaced parts of the separation region; providing groups of channels to receive the slurry after the slurry has passed through the separation region, the particles as to which $(\chi_p-\chi_f)$ is positive, while in the separation region, being concentrated in certain zones of the slurry by virtue of the magnetic field gradients so that the slurry with particles as to which $(\chi_p-\chi_f)$ is positive are received on a continuous basis as a continuous flow stream by some channels and the particles as to which $(\chi_p-\chi_f)$ is minus, while in the separation on region, being concentrated in other zones by virtue of the magnetic field gradients so that slurry with a higher proportion of particles as to which $(\chi_p-\chi_f)$ is minus are received on continuous basis as a continuous flow stream by other of the channels.

15. A magnetic separator that receives slurry as a fluid stream containing particles comprising a fluid whose susceptibility is $\chi_f$ and particles having a range of susceptibilities and acts to concentrate particles of greater susceptibility at a plurality of first transversely-spaced regions of the stream and particles of lesser susceptibility at a plurality of second transversely-spaced regions of the stream, that comprises: a non-magnetic outer housing to receive the slurry in the form of a fluid stream which flows through the housing in the longitudinal direction; a plurality of small-diameter, transversely-spaced magnetic rods disposed within the housing and oriented substantially in said longitudinal direction, the slurry flowing longitudinally past the rods as it moves longitudinally through the housing; means providing a transverse magnetic field in the space occupied by the rods and, in particular, at the upstream portion of the rods to provide high magnetic field gradients around said upstream portions, said field gradients creating forces upon the particles, said forces serving to move the particles transversely within the fluid stream toward a first transversely-spaced region or a second transversely-spaced region on the basis of particle susceptibility; and a plurality of channels disposed adjacent each rod and being located downstream from the upstream portion of the rod, the fluid stream entering the channels only after it has spent sufficient time in said upstream portion for a significant amount of said particles to migrate by virtue of said forces to one of said regions.

16. A magnetic separator as claimed in claim 15 comprising many said rods, each rod being small enough in cross dimensions to provide the necessary field gradient, but not so small that it will not affect the magnetic field, the particles having susceptibilities $\chi_p^+$ and $\chi_p^-$.

17. A magnetic separator that receives slurry as a fluid stream containing particles with a range of susceptibilities and acts to concentrate the particles at a plurality of first transversely-spaced regions of the streams and a plurality of second transversely-spaced regions of the stream on the basis of susceptibility, that comprises: a plurality of small-diameter, transversely-spaced magnetic rods disposed in a separation region and oriented in the direction of fluid flow therethrough, the slurry flowing longitudinally past the rods as it moves through the separation region; means providing a transverse magnetic field in the space occupied by the rods and, in particular, at the upstream portion of the rods to provide high magnetic field gradients around said upstream portions, said field gradients creating forces upon the particles, said forces serving to move the particles transversely within the fluid stream toward one of said transversely-spaced regions, one of said plurality of transversely-spaced regions being disposed at each side of each rod; and a plurality of channels disposed adjacent each rod and being located downstream from the upstream portion of the rod, the fluid stream entering the channels only after it has spent sufficient time in said upstream portion for a significant amount of said particles to migrate by virtue of said forces.

18. A magnetic separator as claimed in claim 17 comprising many closely-spaced ferromagnetic rods in the separation region, the separation region being sufficiently long in the direction of fluid flow to provide adequate residence time for migration to occur.

* * * * *